US007985146B2

(12) United States Patent
Lin et al.

(10) Patent No.: US 7,985,146 B2
(45) Date of Patent: Jul. 26, 2011

(54) GOLF CLUB HEAD AND FACE INSERT

(75) Inventors: Mark Lin, San Diego, CA (US); Bing-Ling Chao, San Diego, CA (US); Citra A. Le, San Diego, CA (US); Todd P. Beach, San Diego, CA (US); Benoit Vincent, Encinitas, CA (US); Peter L. Larsen, San Marcos, CA (US); Marc Kronenberg, San Diego, CA (US); Drew T. DeShiell, Oceanside, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 293 days.

(21) Appl. No.: 11/823,638

(22) Filed: Jun. 27, 2007

(65) Prior Publication Data

US 2009/0005191 A1 Jan. 1, 2009

(51) Int. Cl.
*A63B 53/04* (2006.01)

(52) U.S. Cl. ..... 473/330; 473/342

(58) Field of Classification Search ..... 473/237, 473/324–350, 250, 251
See application file for complete search history.

(56) References Cited

U.S. PATENT DOCUMENTS

| | | | | | |
|---|---|---|---|---|---|
| 1,289,553 | A | * | 12/1918 | Sanders | 473/331 |
| 2,660,436 | A | * | 11/1953 | Grossman | 473/237 |
| 3,071,379 | A | * | 1/1963 | Ramsey | 473/237 |
| 3,754,764 | A | * | 8/1973 | Manheck | 473/237 |
| 4,529,203 | A | * | 7/1985 | Ribaudo | 473/331 |
| 4,676,508 | A | * | 6/1987 | Dilny | 473/237 |
| 4,768,787 | A | * | 9/1988 | Shira | 473/331 |
| 4,792,140 | A | * | 12/1988 | Yamaguchi et al. | 473/331 |
| 4,974,851 | A | * | 12/1990 | Closser et al. | 473/237 |
| 5,033,746 | A | * | 7/1991 | Jones | 473/237 |
| 5,100,144 | A | * | 3/1992 | Okumoto et al. | 473/331 |
| 5,142,309 | A | * | 8/1992 | Lee | 473/237 |

(Continued)

FOREIGN PATENT DOCUMENTS

EP 0982052 A1 3/2000

(Continued)

OTHER PUBLICATIONS

Description of Existing Clubs, (Letter).

*Primary Examiner* — Alvin A Hunter
(74) *Attorney, Agent, or Firm* — Klarquist Sparkman, LLP

(57) ABSTRACT

A face insert for golf club head in one embodiment can comprise a substrate comprising a score line groove-free front surface. A cover layer is provided at least on the front surface of the substrate. The cover layer can alternatively overlay at least a portion of the peripheral edge of the substrate. The cover layer comprises a ball-striking surface spaced by the cover layer from the substrate. Plural elongated score line grooves can extend into the polymer layer from the ball-striking surface. In addition, visible markings are interposed between the cover layer and the front surface of the substrate, the visible markings being visible through the cover layer. In one form the visible markings comprise elongated score line markings and target markings in a central portion of the substrate. The visible markings can be screen-printed markings, which are then protected by the cover layer from wear. The cover layer can be molded and can be a polymer layer. The score line grooves can be formed, for example, by molding during molding of the polymer layer.

17 Claims, 7 Drawing Sheets

U.S. PATENT DOCUMENTS

| | | | | | |
|---|---|---|---|---|---|
| 5,158,289 | A | | 10/1992 | Okumoto et al. | |
| 5,354,059 | A | * | 10/1994 | Stuff | 473/329 |
| 5,531,439 | A | * | 7/1996 | Azzarella | 473/331 |
| 5,597,361 | A | * | 1/1997 | Hope | 473/237 |
| 5,688,190 | A | * | 11/1997 | Rowland et al. | 473/330 |
| 5,690,561 | A | * | 11/1997 | Rowland et al. | 473/330 |
| 5,697,855 | A | * | 12/1997 | Aizawa | 473/350 |
| 5,743,812 | A | * | 4/1998 | Card | 473/327 |
| 5,773,154 | A | | 6/1998 | Takada | |
| 5,779,556 | A | * | 7/1998 | Cervantes et al. | 473/237 |
| 5,804,272 | A | * | 9/1998 | Schrader | 428/40.1 |
| 5,851,158 | A | * | 12/1998 | Winrow et al. | 473/330 |
| 5,885,171 | A | * | 3/1999 | Sharpe | 473/330 |
| 5,885,173 | A | * | 3/1999 | Keller | 473/385 |
| 6,030,294 | A | * | 2/2000 | Shira | 473/342 |
| 6,074,309 | A | * | 6/2000 | Mahaffey | 473/342 |
| 6,200,229 | B1 | * | 3/2001 | Grace et al. | 473/324 |
| 6,358,158 | B2 | * | 3/2002 | Peters et al. | 473/291 |
| 6,390,932 | B1 | | 5/2002 | Kosmatka et al. | |
| 6,425,831 | B1 | * | 7/2002 | Heene et al. | 473/332 |
| 6,428,427 | B1 | * | 8/2002 | Kosmatka | 473/349 |
| 6,435,980 | B1 | | 8/2002 | Reyes et al. | |
| 6,607,451 | B2 | | 8/2003 | Kosmatka et al. | |
| 6,638,182 | B2 | * | 10/2003 | Kosmatka | 473/331 |
| 6,719,644 | B2 | * | 4/2004 | Beach | 473/330 |
| 6,729,972 | B2 | * | 5/2004 | Boord | 473/340 |
| 6,739,980 | B2 | * | 5/2004 | Scott et al. | 473/200 |
| 6,800,038 | B2 | | 10/2004 | Willett et al. | |
| 6,824,475 | B2 | | 11/2004 | Burnett et al. | |
| 6,904,663 | B2 | | 6/2005 | Willett et al. | |
| 6,932,715 | B2 | | 8/2005 | Sano | |
| 6,932,716 | B2 | | 8/2005 | Ehlers et al. | |
| 6,997,820 | B2 | | 2/2006 | Willett et al. | |
| 7,086,956 | B2 | * | 8/2006 | Matthews | 473/226 |
| 7,131,912 | B1 | * | 11/2006 | Knuth | 473/342 |
| 7,134,967 | B2 | * | 11/2006 | Lester | 473/237 |
| 7,166,039 | B2 | * | 1/2007 | Hettinger et al. | 473/331 |
| 7,278,926 | B2 | * | 10/2007 | Frame | 473/329 |
| 7,396,295 | B1 | * | 7/2008 | Frame et al. | 473/337 |
| 7,452,283 | B2 | * | 11/2008 | Hettinger et al. | 473/249 |
| 7,465,240 | B2 | * | 12/2008 | Frame | 473/329 |
| 7,527,565 | B1 | | 5/2009 | Ehlers et al. | |
| 7,559,852 | B2 | * | 7/2009 | Werner et al. | 473/314 |
| 2004/0235584 | A1 | | 11/2004 | Chao et al. | |
| 2005/0239575 | A1 | | 10/2005 | Chao et al. | |

FOREIGN PATENT DOCUMENTS

| | | | | |
|---|---|---|---|---|
| JP | 60083677 | A | * | 5/1985 |
| JP | 04109974 | A | * | 4/1992 |
| JP | 04109975 | A | * | 4/1992 |
| JP | 08052243 | A | * | 2/1996 |
| JP | 09009826 | A | * | 1/1997 |
| JP | 10000250 | A | * | 1/1998 |
| JP | 10000251 | A | * | 1/1998 |
| JP | 10033725 | A | * | 2/1998 |
| JP | 10175400 | A | * | 6/1998 |
| JP | 10314350 | A | * | 12/1998 |
| JP | 2005224427 | A | * | 8/2005 |
| WO | WO 99/36132 | | | 7/1999 |

* cited by examiner

GOLF CLUB HEAD AND FACE INSERT

FIELD

This disclosure pertains generally to golf club heads and golf club head face inserts.

BACKGROUND

With the ever-increasing popularity and competitiveness of golf, substantial effort and resources are currently being expended to improve golf clubs so that increasingly more golfers can have more fun and more success at playing golf. Much of this improvement activity has been in the realms of sophisticated materials and club-head engineering. For example, modern "wood-type" golf clubs (notably, "drivers" and "utility clubs"), with their sophisticated shafts and metal club-heads, bear little resemblance to the "wood" drivers, low-loft long-irons, and higher numbered fairway woods used years ago. These modern wood-type clubs are generally called "metal-woods."

An exemplary metal-wood golf club such as a fairway wood or driver typically includes a shaft having a lower end to which a hollow club-head is attached. The club-head usually is made, at least in part, of a light-weight but strong metal such as titanium alloy. The club-head comprises a body to which a face insert (also called "face plate") is attached. The body typically includes a hosel that extends generally upward and is connected to the shaft of the club. The body also includes a heel region situated close to the hosel, a toe region situated opposite the heel region, a sole (lower) region, and a crown (upper) region. The body bears most of the impact load imparted to the face insert when the club-head strikes a golf ball. The face insert defines a front ball striking surface or strike face that actually contacts the golf ball during a normal golf stroke.

In contrast to wood-type clubs used years ago, the club-heads of many modern metal-woods are hollow, which has been made possible by the use of light-weight, strong metals and other materials for fabricating the club-head. Use of titanium and other light-weight metal alloys has permitted the walls of the club-head to be made very thin, which has permitted the club-heads to be made substantially larger than their predecessors. These oversized club-heads tend to provide a larger "sweet spot" on the face insert and higher club-head inertia, thereby making the club-heads more "forgiving" than smaller club-heads. This "forgiveness" means that a golfer using the club who strikes the ball off the center, or "sweet spot," of the face insert will still produce a ball trajectory that is substantially similar to the shot that otherwise would have been made if the golfer struck the ball on the sweet spot. Characteristics, such as size of the sweet spot, are determined by many variables including the shape profile, size, and thickness of the face insert as well as the location of the center of gravity (CG) of the club-head.

There are practical limits to the maximum size of club-heads, based on factors such as the particular material of the club-head, the mass of the club-head, and the strength of the club-head. Since the maximal mass of the club-head is limited under United States Golf Association (USGA) rules, as the club-head size is increased, the walls of the body and face plate generally are made correspondingly thinner.

To achieve high rotational moments of inertia, and thus more resistance to twisting or rotation upon impact with a golf ball, and thus more forgiveness, the mass of the club-head is typically distributed as much as possible around the periphery of the club-head and rearward of the face plate. As a result, the club-head's center of gravity generally is located rearwardly from the face plate at a prescribed location, which also helps the club to produce a desired launch angle upon impact with a golf ball.

Another factor in club-head design is the face insert or face plate. Impact of the face plate with the golf ball causes deflection of the face plate. This deflection and the subsequent recoil are measured as the club-head's coefficient of restitution (COR). A thinner face plate generally deflects more at impact than a thicker face plate of the same material. Thus, a club-head having a thin face plate can impart more energy and thus a higher initial velocity (rebound velocity) to a struck golf ball than a club with a thicker, more rigid face plate. This rebound phenomenon is called the "trampoline effect" and is an important determinant of the flight distance of the struck ball. Since face-plate deflection is usually greater in the sweet spot of the face plate, a ball struck by the sweet spot generally will have a higher rebound velocity than a ball struck off-center. Face plates of various thickness configurations have been proposed to adjust the characteristics of the face plate. For example, face plates can have a thicker center portion or a thin central portion surrounded by a thicker ring portion. Because of the importance of the trampoline effect, the COR of clubs is limited under USGA rules.

Wood-type drivers often are provided with score line grooves extending into the striking surface of the golf club head. Grooves on a wood-type driver club have little impact on the flight of the golf ball, except under wet conditions. However, they are often used by a golfer to line up a golf shot prior to swinging the club. To make these score line grooves more visible, paint has been used to partially fill the grooves, making them more visible. The paint is protected somewhat from being worn off by being recessed into the grooves from the outermost ball striking surface. Nevertheless, there is some risk of the paint being worn off.

In addition, some golf clubs have been provided with face inserts comprising a composite material impregnated with resin. Such materials can be prone to scratching.

Therefore, the need exists for an improved golf club head, a face insert therefor, and a method of manufacturing thereof.

SUMMARY

A golf club head comprises body comprised of a top, a sole, a toe, a heel, and a front. The body can be hollow, wherein the top, sole, toe, heel, and front have corresponding walls. An example is a body for a modern metal-wood. Alternatively, one or more of the top, sole, toe and heel can have a "solid" or partially solid configuration, such as in any of the various "irons."

A face insert or face plate is attached to the front of the body and has a front surface, a back surface, a periphery, a toe zone, a heel zone, an upper zone, a lower zone, and a central zone. The reverse surface can have a variety of thickness-altering features if desired, such as, for example, a central recess surrounded by an annular ridge and vertical flanking recesses, or a thickened central region.

In accordance with one embodiment, a face insert for golf club head comprises a substrate with a front surface. The front surface can be a score line groove-free surface. A cover layer, for example of polymer, is provided to overlie at least the front surface of the substrate. The cover layer can also overlie the front and at least a portion of the, or the entire, peripheral edge of the substrate in an embodiment. The cover layer comprises an exterior ball striking surface spaced by the cover layer from the front surface of the substrate. Plural elongating score line grooves can extend into the cover layer from the ball-striking surface. In addition, visible markings are interposed between the cover layer and the front surface of the substrate, such as on the front surface of the substrate. The visible markings are visible through the cover layer and in one form comprise elongated visible score line markings. The visible markings also can comprise target markings in a central portion of the substrate, which can be spaced from respective first and second sets of score line visible markings that extend, respectively, at least partially across the toe and heel portions of the substrate. The score line grooves can comprise first and second sets of grooves overlying and aligned with the respective first and second sets of score line markings. The central portion of the cover layer can be score line groove-free. The substrate can also comprise a composite substrate.

In accordance with another aspect of an embodiment, the visible markings can be screen-printed markings, which are then protected by the cover layer from wear.

In accordance with another embodiment, the cover layer can be molded. In addition, the score line grooves can be formed, for example by molding, during molding of the cover layer.

In accordance with an embodiment, the face insert is combined with a golf club head body to form a golf club head.

The foregoing and additional features and advantages of the invention will be more readily apparent from the following detailed description, which proceeds with reference to the accompanying drawings.

DETAILED DESCRIPTION

This disclosure is set forth in the context of representative embodiments that are not intended to be limiting in any way.

In the following description, certain terms may be used such as "up," "down,", "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Figure 1:
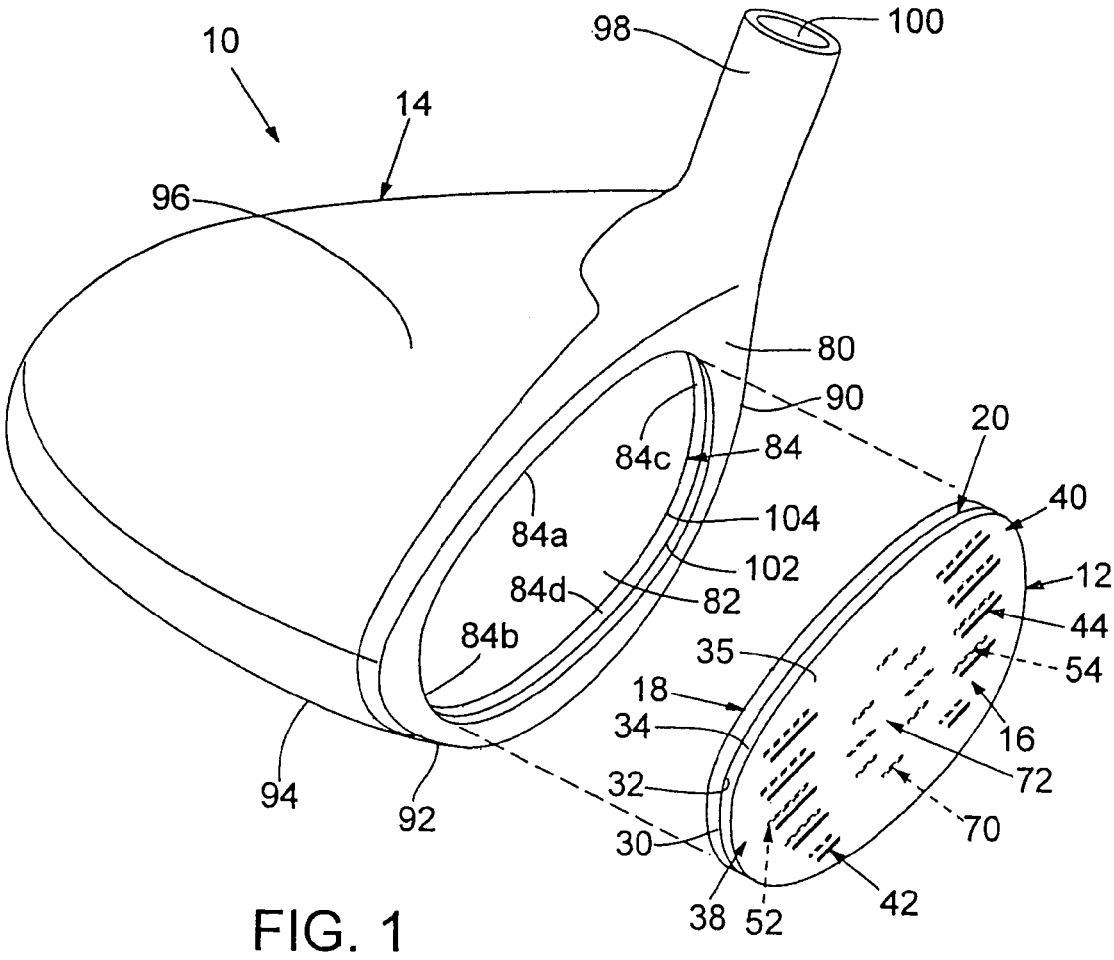
FIG. 1 is a perspective view illustrating certain features of an exemplary wood-type golf club head in accordance with one embodiment.

The main features of an exemplary metal-wood golf club head 10 are depicted in FIG. 1. The golf club head 10 comprises a face insert or face plate 12 and a body 14. The face insert 12, also called a "strike plate," in the exemplary form shown has convexity, and has an external ("obverse") ball-striking surface 16, a back or internal surface 18 and a periphery or peripheral edge 20. The illustrated face insert 12 comprises a substrate 30 having a front surface 32. The front surface 32 is overlaid by a cover layer 34, as described in greater detail below. Desirably, cover layer 34 extends to at least the periphery 30 of the face insert 12, although this is not required. In a desirable alternative embodiment described below, cover layer 34 overlays the major exposed surface of the face insert and at least a portion of the peripheral edge, and more desirably the entire peripheral edge, of the face insert. In the case of a face insert comprised of plural laminations, in the latter embodiments the overlapping cover layer protects the edge and reduces the risk of de-lamination.

The cover layer 34 is desirably provided with a series of score line grooves that extend inwardly into the surface of the cover layer from the exterior most surface 35 of the cover layer. In one exemplary form, the score line grooves can extend from locations adjacent to the peripheral edge of the cover layer entirely across the cover layer to locations spaced inwardly from the peripheral edge on the opposite side of the cover layer.

Figure 1A:
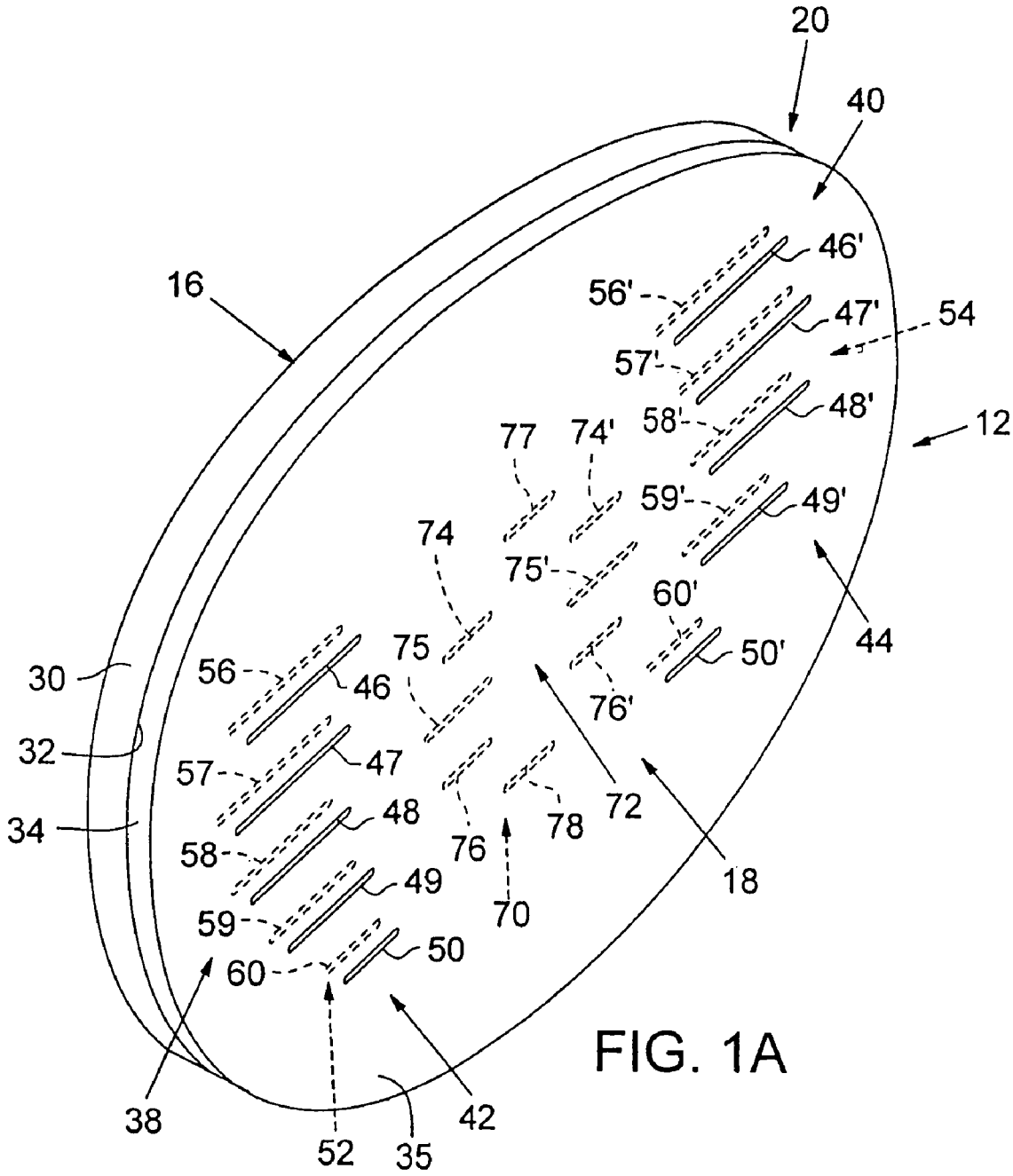
FIG. 1A is an enlarged view of an exemplary face insert usable in the golf club head of FIG. 1.
Figure 2:
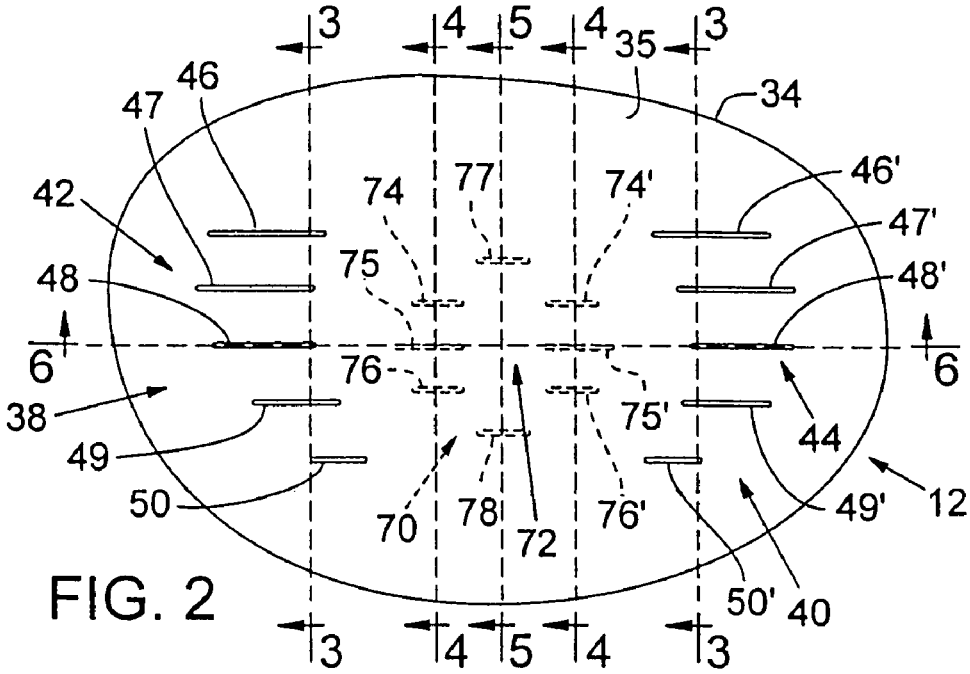
FIG. 2 is a front view of one embodiment of a face insert utilizable in the golf club head of FIG. 1

Alternatively, the grooves can comprise a series of grooves or first set of grooves adjacent the toe portion 38 of the face insert and a second set of grooves adjacent the heel portion 40 of the face insert. In FIGS. 1 and 1A, a first set of grooves is indicated generally by the number 42, and a second set of grooves is indicated generally by the number 44. These grooves are shown by solid lines in FIGS. 1 and 1A. In FIG. 1A, the grooves of the first set 42 are designated by the numbers 46-50, and the grooves of the second set 44 are designated by the numbers 46'-50'. In the FIG. 1 embodiment, the central portion of the cover layer can be score line groove-free. The cover layer is sufficiently transparent so that visible markings or visible indicia provided on the substrate 30, for example, on the substrate surface 32, can be seen from the front of the face plate insert through the cover layer.

In FIG. 1, one example of such subsurface visible markings is shown by dashed lines. Although other patterns of visible markings can be used, in the face insert of FIGS. 1 and 1A, these markings can comprise a first set of visible score line markings or indicia 52 located at the toe portion of the face insert and a second set of visible score line markings or indicia 54 located at the heel portion of the face insert. Score line markings of the first set 52 are indicated by the numbers 56-60 in FIG. 1A, and score line markings of the second set 54 are indicated by the numbers 56'-60' in FIG. 1A. Desirably, the score line grooves of the first set 42 are aligned with and directly overlie visible markings of the first set of visible score line markings 52. Likewise, desirably the score line grooves of the first set 44 overlie and are aligned with respective corresponding visible markings of the second set of visible score line markings 54. In FIGS. 1 and 1A, the respective score line grooves and visible score line markings comprise line segments that are desirably parallel to one another, extend horizontally across the face plate insert, are spaced apart from one another and are coextensive with one another. This is not required, as corresponding score line grooves and underlying markings can be of different lengths and shapes and can be misaligned. However, by aligning such markings, the user of a golf club head incorporating such a face insert is provided with dual features (surface and subsurface features) for use in aligning the club face with the golf ball prior to striking the golf ball.

In FIGS. 1 and 1A, the visible markings on the substrate surface 32 also can comprise target markings 70 in a central portion of the face plate insert. These target markings or indicia can comprise, for example, elongated visible line segments at the sides as well as above and below a central sweet spot or target area 72 of the face plate insert. The center of the target area can be, for example, marking-free. These side target line segment indicia are indicated in FIG. 1A by the numbers 74-76 and 74'-76'. The top and bottom line segment indicia are indicated at 97 and 98 in FIG. 1A. The central most target markings 75 and 75' can comprise line segments aligned with a corresponding line segment, 58 and 58', of the visible score line groove markings in the respective toe and heel portions of the face plate insert. Line segments 58 and 58' can also directly underlie and be positioned in alignment with the respective score line grooves 48 and 48'.

The body 14 can comprise a forward wall 80 defining a front opening 82. A face insert support 84 is disposed about the front opening 82. The body 14 comprises a heel 90, a toe 92, a sole 94, a top or crown 96, and a hosel 98. The hosel 98 defines an opening 100 that receives a distal end of a golf club shaft (not shown). The face insert support 84 receives the face insert 12, thereby enclosing the front opening 82. The face insert 12 contributes to the durability and performance characteristics of the golf club head 10. The face insert support 84 comprises respective portions 84*a*-84*d* situated proximally to the crown 96, the toe 92, the heel 90, and the sole 94. The face insert support 84 can be continuous or comprise multiple portions or stops with gaps between them. In the front opening 82, each of the illustrated portions 84*a*-84*d* can together comprise a peripheral wall 102 extending rearwardly from the forward wall 80 and a rear member 104 extending inwardly from the peripheral member 102.

The mass and volume of metal wood-type drivers are governed by USGA rules. Certain types of metal wood-type club-heads are quite large and have a volume that is equal to or nearly equal to 460 $cm^3$, which is the maximum presently allowed by the USGA.

As discussed in U.S. Patent Publication No. 2005/0239575, incorporated herein by reference, the face support 84 contributes to the COR of the face insert 12, while providing durable support for the face insert. The body 14 typically is made of a high-stiffness, high-strength, low-mass metal such as titanium alloy (e.g., Ti-6Al-4V). However, the body can be made of other materials, such as composite materials, and is not required to be homogeneous. The substrate 18 of face plate 12 can be made of the same material as the body 14 (allowing fastening, such as welding of the face plate to the body after positioning the face plate in the opening 82 and resting upon the face insert support 84) or of a different material. Different materials can be difficult to impossible to bond together by welding. Hence, other bonding techniques usually are required in such instances. For example, if substrate 30 of the face plate 12 is comprised of a composite material or plies thereof (for example, prepreg materials as discussed in U.S. Patent Publication No. 2004/0235584, incorporated herein by reference, with woven fiber such as TR50S or 34-700 fibers both from Grafil, Inc. and epoxy resins such as Newport 301 and 350 from Newport Adhesives & Composites, Inc. being specific examples) and the body 14 is made of a metal such as titanium alloy, then the face plate can, for example, be bonded to the body using a suitable adhesive such as an epoxy adhesive.

Figure 8:
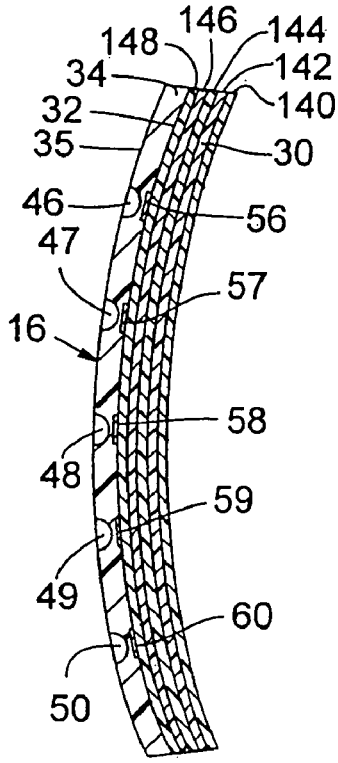
FIG. 8 is a vertical sectional view of the face insert of FIG. 7, taken along line 8-8 of FIG. 7, and showing a substrate of uniform thickness and of multiple plies of composite material.
Figure 7:
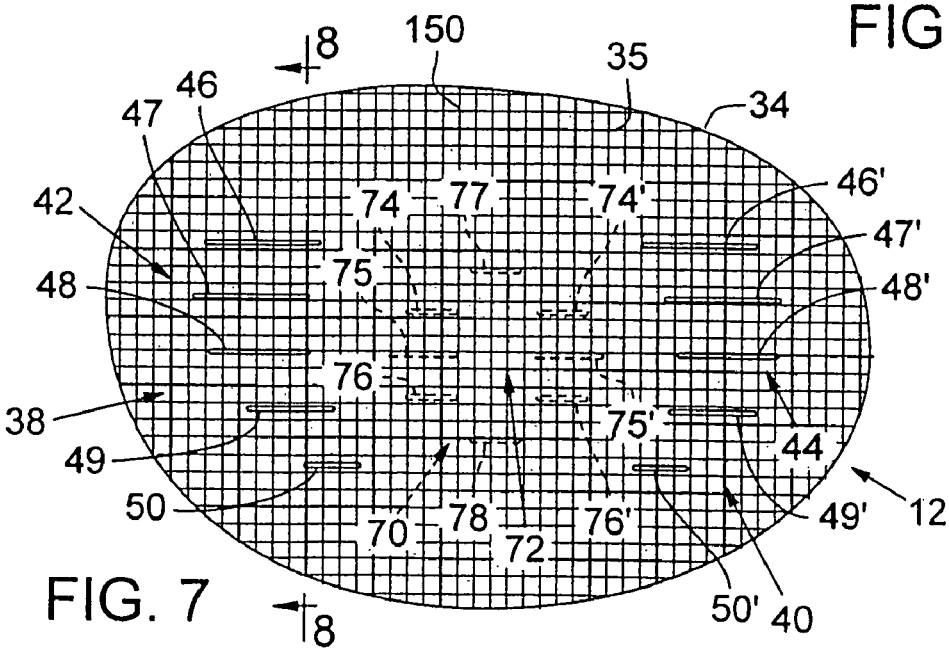
FIG. 7 is a front view of an alternative embodiment of a face insert usable in the golf club head of FIG. 1, having a substrate made of a composite material visible through the cover layer over the substrate.

With reference to FIGS. 2-6, various techniques can be employed to form the face insert 12. A first exemplary technique for forming a substrate 18 for face insert 12 is discussed in U.S. Pat. No. 6,904,663, incorporated herein by reference. This first exemplary technique is especially applicable to a metal substrate. Briefly, a face-plate substrate "blank" can be formed by rolling a sheet of the particular metal (e.g., titanium alloy) from which the face plate substrate 18 is to be made. The metal is rolled to an initial maximal thickness (equal to or greater than the thickness of the thickest portion of the finished substrate). The surface of the substrate blank that is destined to be the reverse surface 18 is machined to form the regions in which the thickness is less than the maximal thickness (e.g., regions other than the region 130 indicated in, for example, FIG. 3). A CNC-milling machine or CNC-lathe, or other suitable machine tool, can be used to perform this machining. A second exemplary technique is discussed in U.S. Patent Publication No. 2004/0099538, incorporated herein by reference. This second exemplary technique generally involves the use of an electrode placed close to the surface of the face-plate blank in regions where material is to be removed. Area-specific removal is governed at least in part by use of a non-conductive template placed in connection with the surface to be "machined." A low-voltage, high-current is passed between the electrode and the face-plate blank in regions in which material is to be removed by electro-chemical reaction. A third exemplary technique, applicable especially in instances in which the face plate is constructed of a composite material, such as shown in FIGS. 7 and 8, is discussed in U.S. Patent Publication No. 2004/0235584. The composite prepreg plies 140-148 (FIG. 8) are stacked and cured in the desired shapes and orientations. The desired thickness contours can be formed during the stacking and curing steps or afterward in a machining step. One or more of these plies can be of a woven material (see the weave pattern 150 of ply 148 in FIG. 7). The weave pattern is desirably visible through the cover layer. Strands forming the woven composite can be oriented horizontally and aligned with visible score line markings and overlying score line grooves. As a specific example, although not required, plies 140, 142, 144 and 146 can each be a layer comprising a unidirectional prepreg ply. The plies or layers 140, 142, 144 and 146 can have strands oriented respectively at 0°, 45°, 90° and −45°, with zero degrees being perpendicular to the score lines. In this example, ply 148 can be a criss-cross woven pattern with the woven strands being at a 0° and 90° orientation on the insert. This woven layer can be secured to other layers of the substrate during forming this substrate. Other suitable substrate manufacturing techniques can alternatively be used.

With reference to FIGS. 1A-6, in one embodiment, the outer surface 32 of substrate 30 is desirably score line groove-free. This surface can be sandblasted or otherwise roughened prior to applying the visual markings (or afterward if the visible markings that are to remain on surface 32 are protected) to provide better adhesion between the substrate and overlying cover layer. However, grooves that could weaken the substrate or undesirably change its properties, although they could be used, are not necessary in this illustrated construction. The visible markings, such as score line markings of the respective score line marking sets 52 and 54 (or alternative markings) and target markings, such as markings 70, can be applied directly to the surface 32. For example, these markings may be painted or otherwise applied to surface 32. In a particularly desirable approach, the markings are screen-printed in the desired pattern on the surface 32. In the absence of an overlying cover layer as explained below, screen-printed markings would not be used on the ball-striking surface of the golf club as they would wear off relatively quickly. In FIGS. 3-6, the visible markings are shown to be of exaggerated thickness for purposes of illustration. They are typically not any thicker than required for them to be visible through the cover layer after the cover layer is applied.

Figure 3:
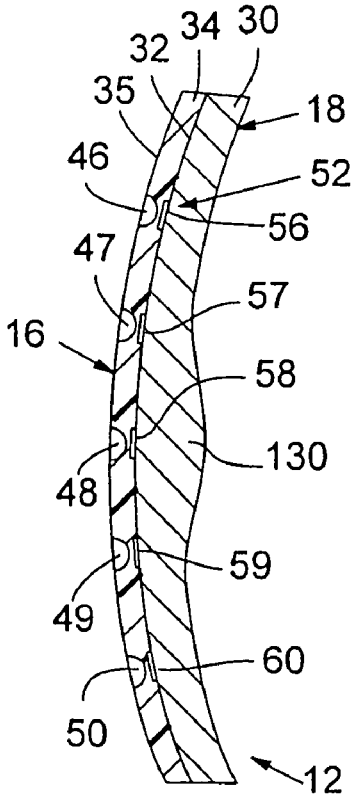
FIG. 3 is a vertical sectional view of the face insert of FIG. 2, taken along either of the lines 3-3 in FIG. 2.
Figure 4:
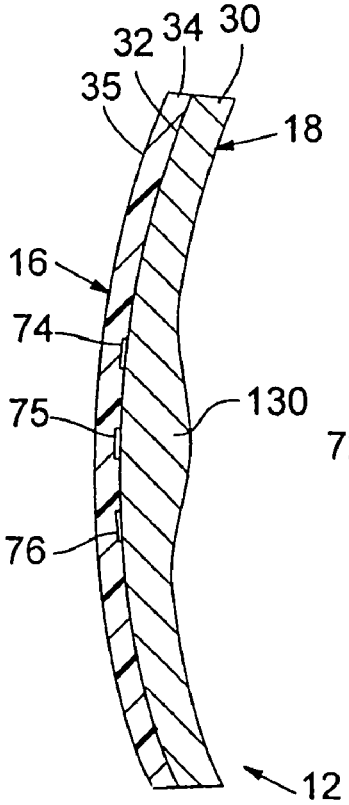
FIG. 4 is a vertical sectional view of the face insert of FIG. 2, taken along either of the lines 4-4 of FIG. 2.
Figure 5:
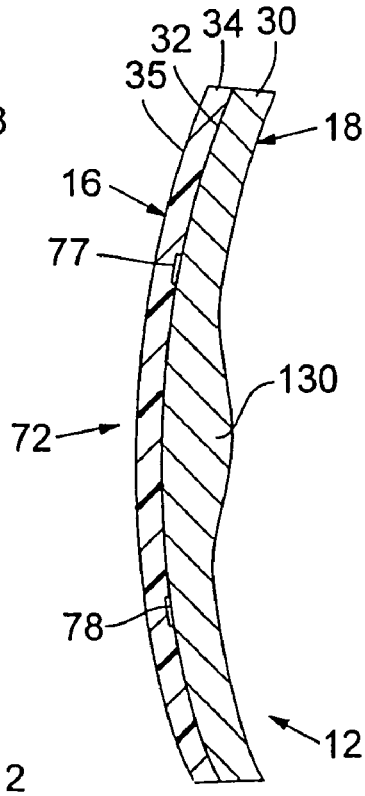
FIG. 5 is a vertical sectional view of the face insert of FIG. 2, taken along line 5-5 of FIG. 2.
Figure 6:
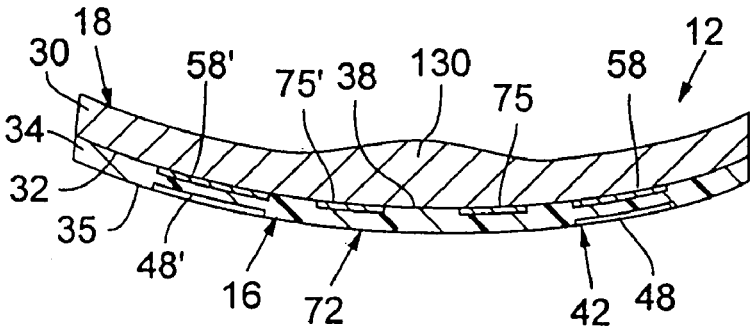
FIG. 6 is a transverse sectional view of the face insert of FIG. 2, taken along line 6-6 of FIG. 2.

With reference to FIG. 3, the cover layer 34 is shown overlying the substrate surface 32. Although the cover layer may be of a variable thickness, a thickness of from 0.4 to 0.5 mm is one specific example. This layer can be thicker or thinner, but will have characteristics that comply with USGA rules. Desirably, the cover layer 34 is formed by molding onto the substrate 30. In one specific approach, a substrate forming plate that is oversized, and from which one or more substrates can be cut out or severed, is overlaid with the covering material in a mold. Following curing of the covering material, the face plate insert 12 comprising the substrate and molded overlying cover layer is severed from the substrate plate. The score line grooves, such as grooves 46-50 and 46'-50', can be molded into the surface of the cover material as the cover material is molded. Alternatively, the score line grooves can be formed after molding, such as by machining. Also, for some golf clubs, for example, metal-wood-type golf club drivers, the exterior score line grooves can be eliminated.

The cover material is desirably a hard, durable polymer material that is sufficiently transparent so that the visible markings on surface 32 of substrate 30 are visible through the cover layer. The cover layer provides additional protection to the substrate 30 and to the visible markings thereon. In addition, the combination of score line grooves and score line visible markings spaced from the base of the grooves by cover layer material provides an enhanced visual reference for use by a golfer in aligning the face of the golf club during a golf club swing. The score line grooves can be filled with paint or other suitable visual enhancing material, but this is typically not done.

A variety of polymer materials can be utilized for the cover layer. For example, polymers from E.I. DuPont de Nemours Co., such as synthetic thermoplastic resin polymers, with Surlyn® 8150 and Surlyn® 9120 being two specific examples that can be used. Polyurethane is yet another example of a suitable polymer.

The polymer can also comprise a polymer blend that can include either Component A or B dispersed in a phase of the other. Preferably, blend compositions comprises between about 1% and about 99% by weight of Component A based on the combined weight of Components A and B, more preferably between about 10% and about 90%, more preferably between about 20% and about 80%, and most preferably, between about 30% and about 70%. Component C is a component that can be added to the blend of A and B (before or after blending) and is desirably present in a quantity sufficient to produce the preferred amount of reaction of the anionic functional groups of Component A after sufficient melt-processing. Preferably, after melt-processing at least about 5% of the anionic functional groups in the chemical structure of Component A have been consumed, more preferably between about 10% and about 90%, more preferably between about 10% and about 80%, and most preferably between about 10% and about 70%.

The blend of these components A, B and C can be melt-processed to produce a reaction product of the anionic functional groups of Component A with the metal cation Component C to form in-situ a composition incorporating a pseudo-crosslinked network of Component A in the presence of Component B. The amount of ionic clustering of the functional groups in the polymer blends can be controlled as necessary for optimum properties of the blend. In the exemplary composition, Component A produces pseudo-crosslinking at the ionic clusters formed in-situ by the clustering of the anionic functional groups reacted with metal cation. Because of the in-situ formation of these clusters in the presence of Component B, and the resulting pseudo-crosslinks, an interpenetrating network is produced.

The composition can be prepared by mixing the above materials into each other thoroughly, either by using a dispersive mixing mechanism, a distributive mixing mechanism, or a combination of these. These mixing methods are well known in the manufacture of polymer blends. As a result of this mixing, the anionic functional group of Component A is dispersed evenly throughout the mixture. Next, a reaction can be made to take place in-situ at the site of the anionic functional groups of Component A with Component C in the presence of Component B. This reaction can be prompted by addition of heat to the mixture. The reaction results in the formation of ionic clusters in Component A and formation of a pseudo-crosslinked structure of Component A in the presence of Component B. Depending upon the structure of Component B, this pseudo-crosslinked Component A can combine with Component B to form a variety of interpenetrating network structures. For example, the materials can form a pseudo-crosslinked network of Component A dispersed in the phase of Component B, or Component B can be dispersed in the phase of the pseudo-crosslinked network of Component A. Component B may or may not also form a network, depending upon its structure, resulting in either: a fully-interpenetrating network, i.e., two independent networks of Components A and B penetrating each other, but not covalently bonded to each other; or, a semi-interpenetrating network of Components A and B, in which Component B forms a linear, grafted, or branched polymer interspersed in the network of Component A. For example, a reactive functional group or an unsaturation in Component B can be reacted to form a crosslinked structure in the presence of the in-situ-formed, psuedo-crosslinked structure of component A, leading to formation of a fully-interpenetrating network. Any anionic functional groups in Component B also can be reacted with the metal cation of Component C, resulting in pseudo-crosslinking via ionic cluster attraction of Component A to Component B. The level of in-situ-formed pseudo-crosslinking in the compositions formed can be controlled as desired by selection and ratio of Components A and B, amount and type of anionic functional group, amount and type of metal cation in Component C, type and degree of chemical reaction in Component B, and degree of pseudo-crosslinking produced of Components A and B.

The mechanical and thermal properties of the resin can be controlled as required by a modifying any of a number of factors, including: the chemical structure of Components A and B, particularly the amount and type of anionic functional groups; mean molecular weight and molecular weight distribution of Components A and B; linearity and crystallinity of Components A and B; type of metal cation in component C; degree of reaction achieved between the anionic functional groups and the metal cation; mix ratio of Component A to Component B; type and degree of chemical reaction in Component B; presence of chemical reaction, such as a crosslinking reaction, between Components A and B; and, the particular mixing methods and conditions used.

Component A can be any monomer, oligomer, prepolymer, or polymer such as incorporating at least 5% by weight of anionic functional groups. Those anionic functional groups can be incorporated into monomeric, oligomeric, prepolymeric, or polymeric structures during the synthesis of Component A, or they can be incorporated into a pre-existing monomer, oligomer, prepolymer, or polymer through sulfonation, phosphonation, or carboxylation to produce Component A.

Examples of suitable materials for use as Component A include, but are not limited to, sulfonated, phosphonated, or carboxylated products of the following: thermoplastic elastomer, thermoset elastomer, synthetic rubber, thermoplastic vulcanizate, copolymeric ionomer, terpolymeric ionomer, polycarbonate, polyolefin, polyamide, copolymeric polyamide, polyesters, polyvinyl alcohols, acrylonitrile-butadiene-styrene copolymers, polyurethane, polyarylate, polyacrylate, polyphenyl ether, modified-polyphenyl ether, high-impact polystyrene, diallyl phthalate polymer, acrylonitrile-styrene-butadiene (ABS), styrene-acrylonitrile (SAN) (including olefin-modified SAN and acrilonitrile styrene acrylonitrile), styrene-maleic anhydryde (S/MA) polymer, styrenic copolymer, functionalized styrenic copolymer, functionalized styrenic terpolymer, styrenic terpolymer, cellulose polymer, liquid crystal polymer (LCP), ethylene-propylene-diene terpolymer (EPDM), ethylene-propylene copolymer, ethylene vinyl acetate, polyurea, and polysiloxane, or any metallocene-catalyzed polymers of these species.

Particularly suitable polymers for use as Component A within the scope of this disclosure include sulfonated, phosphonated, or carboxylated products of the following: polyethyleneterephthalate, polybutyleneterephthalate, polytrimethyleneterephthalate, ethylene-carbon monoxide copolymer, polyvinyl-diene fluorides, polyphenylenesulfide, polypropyleneoxide, polyphenyloxide, polypropylene, functionalized polypropylene, polyethylene, ethylene-octene copolymer, ethylene-methyl acrylate, ethylene-butyl acrylate, polycarbonate, polysiloxane, functionalized polysiloxane, copolymeric ionomer, terpolymeric ionomer, polyetherester elastomer, polyesterester elastomer, polyetheramide elastomer, propylene-butadiene copolymer, modified copolymer of ethylene and propylene, styrenic copolymer (including styrenic block copolymer and randomly distributed styrenic copolymer, such as styrene-isobutylene copolymer and styrene-butadiene copolymer), partially or fully hydrogenated styrene-butadiene-styrene block copolymers such as styrene-(ethylene-propylene)-styrene or styrene-(ethylene-butylene)-styrene block copolymers, partially or fully hydrogenated styrene-butadiene-styrene block copolymers with functional group, polymers based on ethylene-propylene-(diene), polymers based on functionalized ethylene-propylene (diene), dynamically vulcanized polypropylene/ ethylene-propylene-diene-copolymer, thermoplastic vulcanizates based on ethylene-propylene-(diene), thermoplastic polyetherurethane, thermoplastic polyesterurethane, compositions for making thermoset polyurethane, thermoset polyurethane, natural rubber, styrene-butadiene rubber, nitrile rubber, chloroprene rubber, fluorocarbon rubber, butyl rubber, acrylic rubber, silicone rubber, chlorosulfonated polyethylene, polyisobutylene, alfin rubber, polyester rubber, epichlorphydrin rubber, chlorinated isobutylene-isoprene rubber, nitrile-isobutylene rubber, 1,2-polybutadiene, 1,4-polybutadiene, cis-polyisoprene, trans-polyisoprene, and polybutylene-octene, or any metallocene-catalyzed polymers of the above-listed species. Suitable polyamides for sulfonation, phosphonation, or carboxylation are products of the following include resins obtained by: (1) polycondensation of (a) a dicarboxylic acid, such as oxalic acid, adipic acid, sebacic acid, terephthalic acid, isophthalic acid or 1,4-cyclohexylidicarboxylic acid, with (b) a diamine, such as ethylene-diamine, tetramethylenediamine, pentamethylenediamine, hexamethylene-diamine or decamethylenediamine, 1,4-cyclohexyldiamine or m-xylylenediamine; (2) a ring-opening polymerization of cyclic lactam, such as e-caprolactam; (3) polycondensation of an aminocarboxylic acid, such as 6-aminocaproic acid, 9-aminononaoic acid, 11-aminoudecanoic acid or 12-aminododecanoic acid; or, (4) copolymerization of a cyclic lactam with a dicarboxylic acid and a diamine. Specific examples of suitable polyamides for sulfonation, phosphonation, or carboxylation include polyamide 6; polyamide 11; polyamide 12; polyamide 4,6; polyamide 6,6; polyamide 6,9; polyamide 6,10; polyamide 6,12; PA12,CX; PA12, IT; PPA; PA6, IT; and PA6/PPE.

Examples of suitable materials for use as Component A include homopolymers, copolymers, and terpolymers. A preferred copolymer is a copolymer of: an α-olefin having the form $RCH{=}CH_2$, where R is a radical selected from the class consisting of hydrogen and alkyl radicals having 1 to 8 carbon atoms; and, an α-β-ethylenically unsaturated carboxylic acid having preferably 3 to 8 carbon atoms. Examples of suitable olefins in this copolymer include ethylene, propylene, butene, pentene, hexene, heptene, methylbutene, and methylpentene. Examples of suitable α-β-ethylenically unsaturated carboxylic acids in this copolymer include: acrylic acid, methacrylic acid, ethacrylic acid, itaconic acid, maleic acid, fumaric acid, monoesters of dicarboxylic acid (such as methyl hydrogen maleate, methyl hydrogen fumarate, and ethyl hydrogen fumarate, and maleic anhydride), and α-β-monoethylenically unsaturated anhydrides of carboxylic acid. A preferred terpolymer is a terpolymer of: an α-olefin having the form $RCH{=}CH_2$, where R is a radical selected from the class consisting of hydrogen and alkyl radicals having 1 to 8 carbon atoms; an α-β-ethylenically unsaturated carboxylic acid having preferably 3 to 8 carbon atoms; and an acrylate ester having from 1 to 21 carbon atoms.

Preferred, but non-limiting, examples of suitable copolymers and terpolymers for use can include copolymers or terpolymers of: ethylene/acrylic acid, ethylene/methacrylic acid, ethylene/itaconic acid, ethylene/methyl hydrogen maleate, ethylene/maleic acid, ethylene/methacrylic acid/ethylacrylate, ethylene/itaconic acid/methyl methacrylate, ethylene/methyl hydrogen maleate/ethyl acrylate, ethylene/methacrylic acid/vinyl acetate, ethylene/acrylic acid/vinyl alcohol, ethylene/propylene/acrylic acid, ethylene/styrene/acrylic acid, ethylene/methacrylic acid/acrylonitrile, ethylene/fumaric acid/vinyl methyl ether, ethylene/vinyl chloride/ acrylic acid, ethylene/vinyldiene chloride/acrylic acid, ethylene/vinyl fluoride/methacrylic acid, and ethylene/chlorotrifluoroethylene/ methacrylic acid, or any metallocene-catalyzed polymers of the above-listed species. Examples of suitable copolymers for use with the present invention are marketed under the name PRIMACOR by Dow Chemical Company of Midland Mich., and NUCREL by E.I. DuPont de Nemours & Co. of Wilmington, Del.

Additional examples of materials suitable for use as Component A include the reaction products of compositions incorporating diisocyanate, diamine, polyamine, or polyol incorporating the anionic functional groups discussed above, as well as any combination of those reaction products, such as prepolymers or polymers incorporating these anionic functional groups. Further examples of materials suitable for use as Component A include oxa acids, oxa esters, or polymers incorporating oxa acids or oxa esters as a co-monomer. Particular examples of suitable oxa acids and their ester include: 3,6-dioxaheptanoic acid, 3,6,9-trioxadecanoic acid, 3,6,9-trioxaudecanedioic acid, 3,6,9-trioxaudecanedioic ester, polyglycol diacid, and polyglycol diacid ester.

Component B can be any monomer, oligomer, or polymer, preferably having a lower weight percentage of anionic functional groups than that present in Component A in the weight ranges discussed above, and most preferably free of such functional groups. Examples of suitable materials for Component B include, but are not limited to, the following: thermoplastic elastomer, thermoset elastomer, synthetic rubber, thermoplastic vulcanizate, copolymeric ionomer, terpolymeric ionomer, polycarbonate, polyolefin, polyamide, copolymeric polyamide, polyesters, polyvinyl alcohols, acrylonitrile-butadiene-styrene copolymers, polyurethane, polyarylate, polyacrylate, polyphenyl ether, modified-polyphenyl ether, high-impact polystyrene, diallyl phthalate polymer, metallocene catalyzed polymers, acrylonitrile-styrene-butadiene (ABS), styrene-acrylonitrile (SAN) (including olefin-modified SAN and acrilonitrile styrene acrylonitrile), styrene-maleic anhydryde (S/MA) polymer, styrenic copolymer, functionalized styrenic copolymer, functionalized styrenic terpolymer, styrenic terpolymer, cellulose polymer, liquid crystal polymer (LCP), ethylene-propylene-diene terpolymer (EPDM), ethylene-propylene copolymer, ethylene vinyl acetate, polyurea, and polysiloxane or any metallocene-catalyzed polymers of these species. Particularly suitable polymers for use as Component B within the scope of the present invention include polyethylene-terephthalate, polybutylene-terephthalate, polytrimethylene-terephthalate, ethylene-carbon monoxide copolymer, polyvinyl-diene fluorides, polyphenylenesulfide, polypropyleneoxide, polyphenyloxide, polypropylene, functionalized polypropylene, polyethylene, ethylene-octene copolymer, ethylene-methyl acrylate, ethylene-butyl acrylate, polycarbonate, polysiloxane, functionalized polysiloxane, copolymeric ionomer, terpolymeric ionomer, polyetherester elastomer, polyesterester elastomer, polyetheramide elastomer, propylene-butadiene copolymer, modified copolymer of ethylene and propylene, styrenic copolymer (including styrenic block copolymer and randomly distributed styrenic copolymer, such as styrene-isobutylene copolymer and styrene-butadiene copolymer), partially or fully hydrogenated styrene-butadiene-styrene block copolymers such as styrene-(ethylene-propylene)-styrene or styrene-(ethylene-butylene)-styrene block copolymers, partially or fully hydrogenated styrene-butadiene-styrene block copolymers with functional group, polymers based on ethylene-propylene-(diene), polymers based on functionalized ethylene-propylene-(diene), dynamically vulcanized polypropylene/ethylene-propylene-diene-copolymer, thermoplastic vulcanizates based on ethylene-propylene-(diene), thermoplastic polyetherurethane, thermoplastic polyesterurethane, compositions for making thermoset polyurethane, thermoset polyurethane, natural rubber, styrene-butadiene rubber, nitrile rubber, chloroprene rubber, fluorocarbon rubber, butyl rubber, acrylic rubber, silicone rubber, chlorosulfonated polyethylene, polyisobutylene, alfin rubber, polyester rubber, epichlorphydrin rubber, chlorinated isobutylene-isoprene rubber, nitrile-isobutylene rubber, 1,2-polybutadiene, 1,4-polybutadiene, cis-polyisoprene, trans-polyisoprene, and polybutylene-octene.

Exemplary materials for use as Component B include polyester elastomers marketed under the name PEBAX and LOTADER marketed by ATOFINA Chemicals of Philadelphia, Pa.; HYTREL, FUSABOND, and NUCREL marketed by E.I. DuPont de Nemours & Co. of Wilmington, Del.; SKYPEL and SKYTHANE by S.K. Chemicals of Seoul, South Korea; SEPTON and HYBRAR marketed by Kuraray Company of Kurashiki, Japan; ESTHANE by Noveon; KRATON marketed by Kraton Polymers, and VESTENAMER marketed by Deggusa.

As stated above, Component C is a metal cation in this example. These exemplary metals are from groups IA, IB, IIA, IIB, IIIA, IIIB, IVA, IVB, VA, VB, VIA, VIB, VIIB and VIIIB of the periodic table. Examples of these metals include lithium, sodium, magnesium, aluminum, potassium, calcium, manganese, tungsten, titanium, iron, cobalt, nickel, hafnium, copper, zinc, barium, zirconium, and tin. Suitable metal compounds for use as a source of Component C are, for example, metal salts, preferably metal hydroxides, metal carbonates, or metal acetates. In addition to Components A, B, and C, other materials commonly used in polymer blend compositions, can be incorporated into compositions prepared using the method of the present invention, including: crosslinking agents, co-crosslinking agents, accelerators, activators, UV-active chemicals such as UV initiators, EB-active chemicals, colorants, UV stabilizers, optical brighteners, antioxidants, processing aids, mold release agents, foaming agents, and organic, inorganic or metallic fillers or fibers, including fillers to adjust specific gravity.

Various known methods are suitable for preparation of polymer blends. For example, the three components can be premixed together in any type of suitable mixer, such as a V-blender, tumbler mixer, or blade mixer. This premix then can be melt-processed using an internal mixer, such as Banbury mixer, roll-mill or combination of these, to produce a reaction product of the anionic functional groups of Component A by Component C in the presence of Component B. Alternatively, the premix can be melt-processed using an extruder, such as single screw, co-rotating twin screw, or counter-rotating twin screw extruder, to produce the reaction product. The mixing methods discussed above can be used together to melt-mix the three components to prepare the exemplary compositions. Also, the components can be fed into an extruder simultaneously or sequentially.

Components A and B can be melt-mixed together without Component C, with or without the premixing discussed above, to produce a melt-mixture of the two components. Then, Component C can be separately mixed into the blend of Components A and B. This mixture can be is melt-mixed to produce the reaction product. This two-step mixing can be performed in a single process, such as, for examples an extrusion process using a proper barrel length or screw configuration, along with a multiple feeding system. In this case, Components A and B can be fed into the extruder through a main hopper to be melted and well-mixed while flowing downstream through the extruder. Then Component C can be fed into the extruder to react with the mixture of Components A and B between the feeding port for component C and the die head of the extruder. The final polymer composition then exits from the die. If desired, any extra steps of melt-mixing can be added to either approach of the method of the present invention to provide for improved mixing or completion of the reaction between A and C. Also, additional components discussed above can be incorporated either into a premix, or at any of the melt-mixing stages. Alternatively, Components A, B, and C can be melt-mixed simultaneously to form in-situ a psuedo-crosslinked structure of Component A in the presence of Component B, either as a fully or semi-interpenetrating network.

The compositions prepared using the described method additionally can include copolymers or terpolymers having a glycidyl group, hydroxyl group, maleic anhydride group or carboxylic group. These copolymers and terpolymers comprise an α-olefin. Examples of suitable α-olefins include ethylene, propylene, 1-butene, 1-pentene, 3-methyl-1-butene, 1-hexene, 4-methyl-1-petene, 3-methyl-1-pentene, 1-octene, 1-decene, 1-dodecene, 1-tetradecene, 1-hexadecene, 1-octadecene, 1-eicocene, 1-dococene, 1-tetracocene, 1-hexacocene, 1-octacocene, and 1-triacontene. One or more of these α-olefins may be used. Examples of suitable glycidyl groups in copolymers or terpolymers for use within the scope of the present invention include esters and ethers of aliphatic glycidyl, such as allylglycidylether, vinylglycidylether, glycidyl maleate and itaconatem glycidyl acrylate and methacrylate, and also alicyclic glycidyl esters and ethers, such as 2-cyclohexene-1-glycidylether, cyclohexene-4,5-diglyxidylcarboxylate, cyclohexene-4-glycidyl carboxylate, 5-norboenene-2-methyl-2-glycidyl carboxylate, and endocis-bicyclo(2,2,1)-5-heptene-2,3-diglycidyl dicaroboxylate. These polymers having a glycidyl group may comprise other monomers, such as esters of unsaturated carboxylic acid, for example, alkyl(meth)acrylates or vinyl esters of unsaturated carboxylic acids. Polymers having a glycidyl group can be obtained by copolymerization or graft polymerization with homopolymers or copolymers. Examples of suitable terpolymers having a glycidyl group include LOTADER AX8900 and LOTADER AX8920 marketed by Elf-Atochem Company, ELVALOY marketed by Du Pont, REXPEARL marketed by Nippon Petrochemicals Co., Ltd. Additional examples of copolymers comprising epoxy monomers and which are suitable for use in compositions prepared using the method of the present invention include styrene-butadiene-styrene block copolymers in which the polybutadiene block contains epoxy group, and styrene-isoprene-styrene block copolymers in which the polyisoprene block contains epoxy. Commercially available examples of these epoxy functional copolymers include ESBS A1005, ESBS A1010, ESBS A1020, ESBS AT018, and ESBS AT019, marketed by Daicel Chemical Industries, Ltd.

Examples of polymers or terpolymers incorporating a maleic anhydride group suitable for use within compositions prepared using the method above can include maleic anhydride-modified ethylene-propylene copolymers, maleic anhydride-modified ethylene-propylene-diene terpolymers, maleic anhydride-modified polyethylenes, maleic anhydride-modified polypropylenes, ethylene-ethylacrylate-maleic anhydride terpolymers, and maleic anhydride-indene-styrene-cumarone polymers. Examples of commercially available copolymers incorporating maleic anhydride include: BONDINE, marketed by Sumitomo Chemical Co., such as BONDINE AX8390, an ethylene-ethyl acrylate-maleic anhydride terpolymer having a combined ethylene acrylate and maleic anhydride content of 32% by weight, and BONDINE TX TX8030, an ethylene-ethyl acrylate-maleic anhydride terpolymer having a combined ethylene acrylate and maleic anhydride content of 15% by weight and a maleic anhydride content of 1% to 4% by weight; maleic anhydride-containing LOTADER 3200, 3210, 6200, 8200, 3300, 3400, 3410, 7500, 5500, 4720, and 4700, marketed by Elf-Atochem; EXXELOR VA1803, a maleic anyhydride-modified ethylene-propylene coploymer having a maleic anyhydride content of 0.7% by weight, marketed by Exxon Chemical Co.; and KRATON FG 1901X, a maleic anhydride functionalized triblock copolymer having polystyrene endblocks and poly(ethylene/butylene) midblocks, marketed by Kraton Company."

Figure 9:
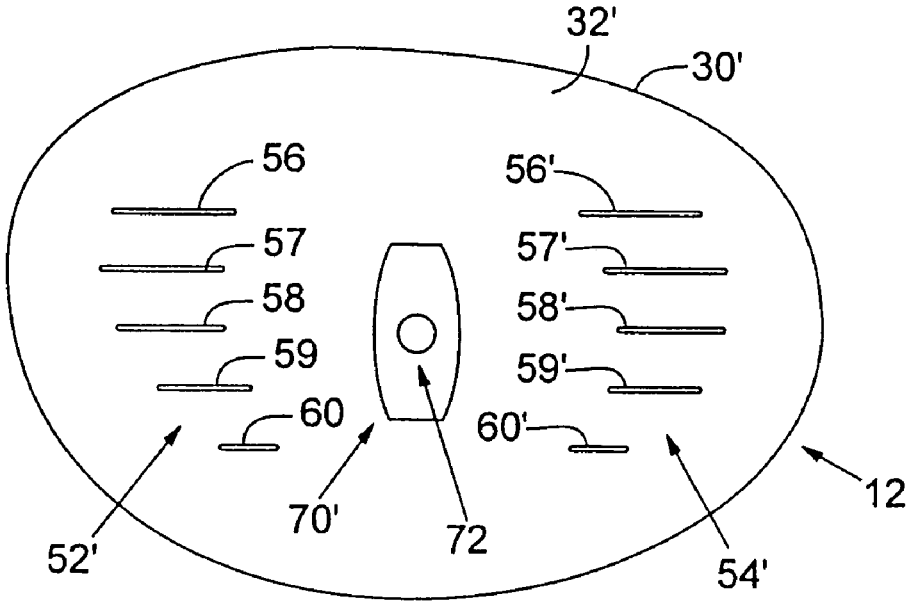
FIG. 9 illustrates an alternative embodiment of a substrate for a face plate insert for use in a golf club head body such as is shown in FIG. 1 and showing score line markings and target markings of a different configuration on the surface of the substrate.

FIG. 9 illustrates an alternative substrate 30' with a front surface 32' and respective first and second sets of score line visual indicia 52' and 54' thereon. In addition, a different configuration of target indicia 70' is shown in FIG. 9.

The score line groove depths can be varied. As one example, the score line groove depths can be from one-third to two-thirds of the thickness of the cover layer, with one-half the thickness of the cover layer being a desirable example. An exemplary range of score line groove depths is from 0.15 mm to 0.5 mm, with the thickness of the cover layer desirably being correspondingly adjusted. Alternatively, the score line grooves can be much shallower, such as between about 0.01 and about 0.10 mm, with 0.02 mm being a specific example. Shallow grooves of this latter type reduce the risk of fracture and subsequent need for face insert thickening. However, both visible score line markings and score line grooves are typically still somewhat visible to the golf club user even though shallow grooves typically cannot hold paint or other groove-indicating material. The depth of the score line grooves also is not required to be uniform.

Figure 10:
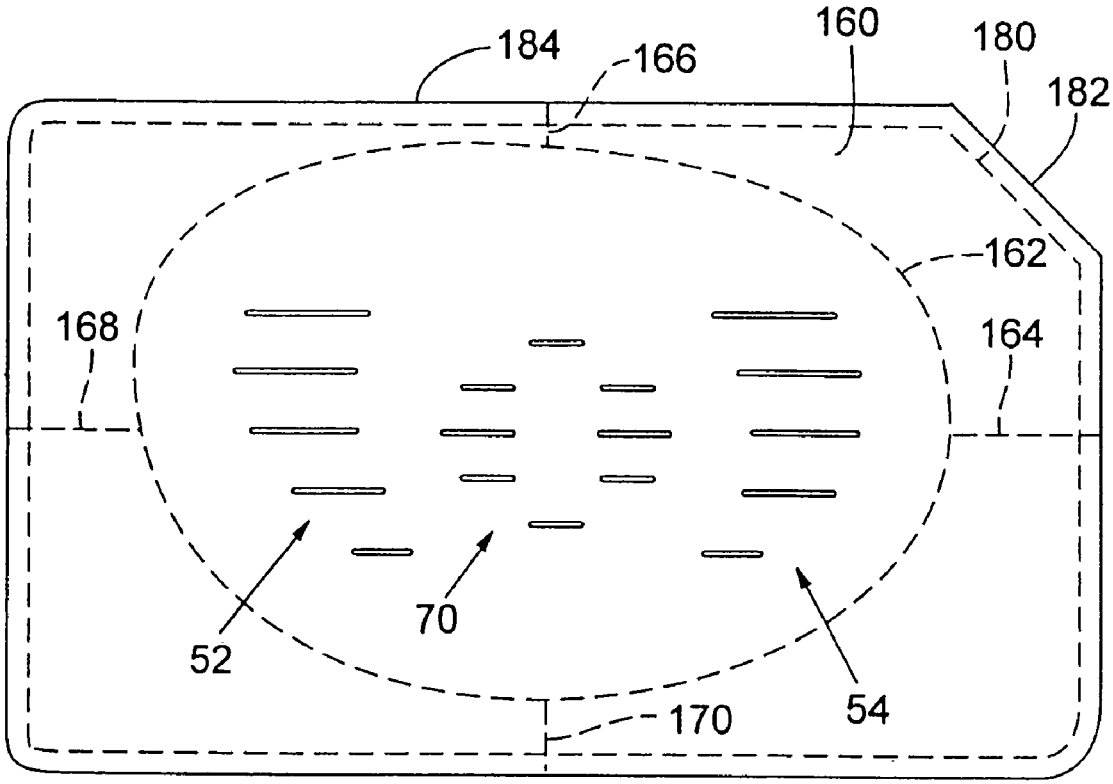
FIG. 10 illustrates a substrate forming plate which can be coated with a covering layer and then severed to provide a face plate insert, such as of the form shown in FIG. 2.
Figure 11:
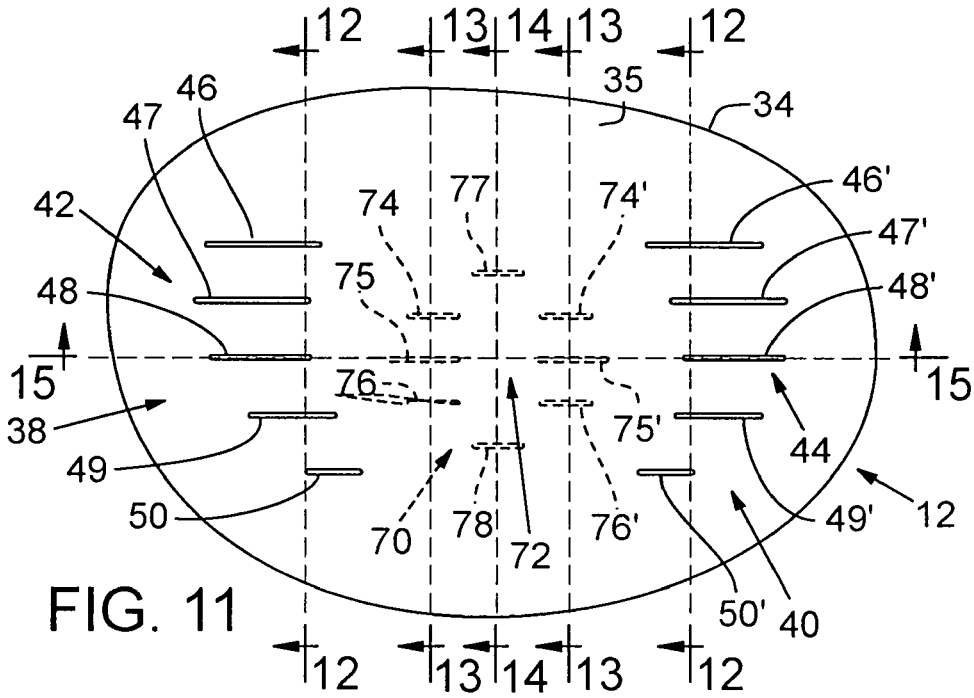
FIG. 11 is a front view of an alternative embodiment of a face insert comprising a cover layer on the major face of the insert and overlaying a peripheral edge of the insert.

With reference to FIG. 10, an exemplary approach for manufacturing a face plate insert in accordance with one embodiment of the disclosure is described. In FIG. 10, a substrate-containing plate 160 is shown. The substrate plate 160 can be formed to have the contour desired for the substrate. In a specific example, the substrate is comprised of composite plies of material that are impregnated with resin and cured, such as described in U.S. Published Application No. 2004/0235584. In FIG. 10, the substrate is shown with sets of visible score line indicia 52, 54 and target indicia 70, which can be screen-printed onto the substrate. In addition reference lines can be provided on the substrate, such as by screen-printing, although such lines are not required. The illustrated reference lines include a generally oval reference 162 that defines the eventual boundary of the illustrated face insert when complete. Line segments 164, 168 along an x-axis and line segments 166, 170 along a y-axis define a reference Cartesian coordinate system that can be used to orient the substrate plate when placed in a mold. Also, the substrate plate 160 has a notched corner 182 which can be used for orientation within a mold that has a corresponding corner projection. In addition, the outer periphery of the substrate plate 160 is indicated at 184. Reference lines 180, spaced inwardly from the outer periphery, are also shown. Although pins or other alignment features can be included in a mold with corresponding alignment apertures in the substrate plate, alignment can also be accomplished by grinding or otherwise reducing portions of the peripheral edge 184 to provide a uniform spacing between the periphery 184 and the reference lines 180 about the entire periphery of the substrate.

Although other methods of casting and molding can be used, a compression molding approach has proven suitable. An exemplary mold comprises a mold base that can have a texture on the base. In cases where score line grooves are to be formed during the molding process, raised score line ribs can be provided on the mold base which then extend into the surface of the cover layer during molding to form score line grooves when the mold base is separated from the completed face insert. An exemplary mold also can comprise a mold ring for use in containing molding material within the mold and a plunger for applying pressure during the molding process. In examples where a composite substrate is used and a mold is of a material, such as aluminum, with a different thermal expansion coefficient than the substrate, the periphery of the substrate plate 160 may need to be reduced in cross-section to fit the substrate into the mold. The mold and substrate are desirably cleaned, such as with water, prior to molding. The mold is typically heated in a hot press to preheat the mold to a desired temperature for the molding material, such as 300° F. for Surlyn®. In addition, the substrate can be placed on a press platen and also preheated to, for example, 300° F. The mold ring and base can be assembled with the molding material then being placed on the mold base. For example, a layer of Surlyn® pellets or a Surlyn® sheet of the desired material can be placed on the mold base. The mold base is desirably contoured, e.g., curved, to match the contour of the desired shape of the ball-striking surface of the face plate insert. Alternatively, a quantity of polyurethane or other cover layer forming material can be placed in the mold. The thickness of the cover layer can, for example, be controlled by placing stops, such as shims, in the mold cavity. For example, four shims of about 0.8 mm thickness can be placed in the four corners of the mold cavity, assuming the cover layer to be formed is to be 0.8 mm in thickness. The cover layer need not be of a uniform thickness. The mold with the assembled mold ring and platen can again be preheated in a hot press to bring the temperature up to the desired level, such as 300° F. The insert plate 160 can be placed in the mold with the mold being closed and with a pressure-applying plunger in place. Preheating of the assembly can again be accomplished, such as to 300° F. Pressure can then be applied to the mold. As the cover layer forming material such as Surlyn® flows, the pressure will tend to drop and thus can be increased over time to maintain the load. Stepwise increments of pressure can be used, such as maintaining an initial load of 2,000 lb on the mold, increasing the load to 3,000 lb and maintaining it for a period of time, bringing the load up to 5,000 lb in increments over a number of minutes, and then maintaining the pressure at the maximum load. The pressure is desirably maintained as the material cools. Following cooling, the substrate plate 160 with the now formed cover layer is removed. After the protective cover has been molded, the face plate insert can then be severed from substrate plate 160, such as by using a CNC machine or a water jet to obtain a club face insert for attachment, such as by adhesive bonding, onto a club head body. Thus, compression molding is utilized to form the cover plate in this specific example. The result in this example is a face plate insert with a hardened polymer cover layer.

Figure 12:
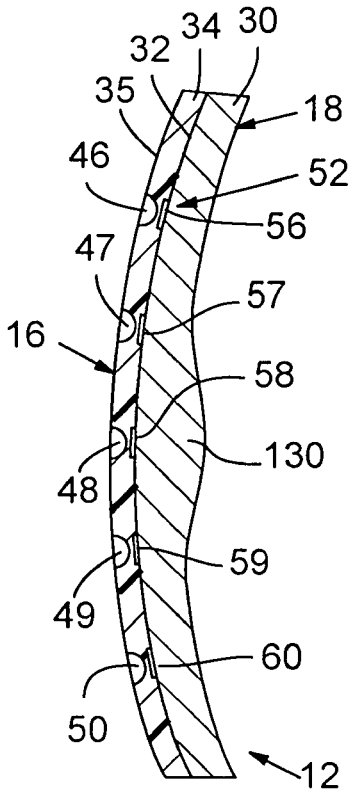
FIG. 12 is a vertical sectional view of the face insert of FIG. 11, taken along either of the lines 12-12 in FIG. 11.
Figure 13:
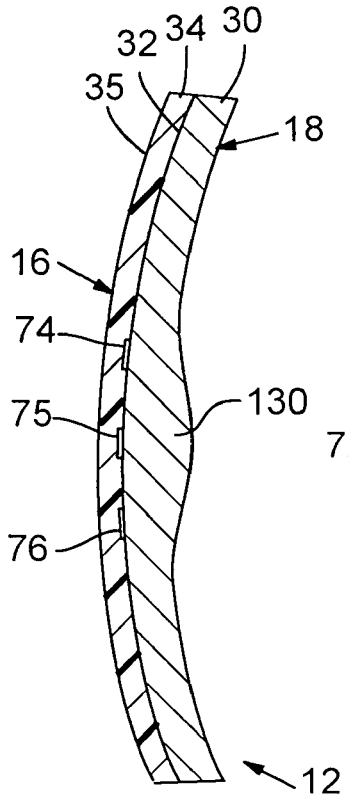
FIG. 13 is a vertical sectional view of the face insert of FIG. 11, taken along either of the lines 13-13 of FIG. 11.
Figure 14:
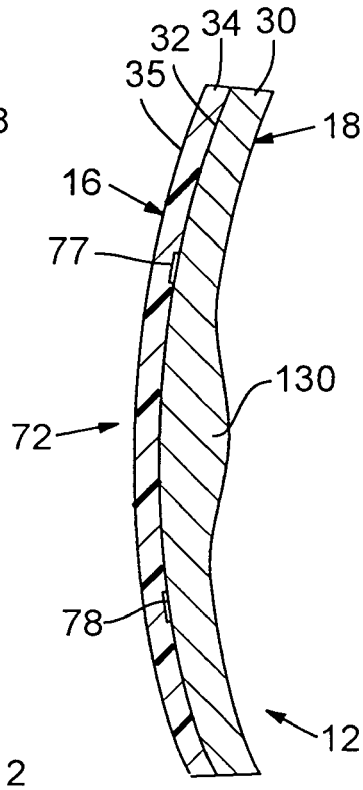
FIG. 14 is a vertical sectional view of the face insert of FIG. 11, taken along line 14-14 of FIG. 11.
Figure 15:
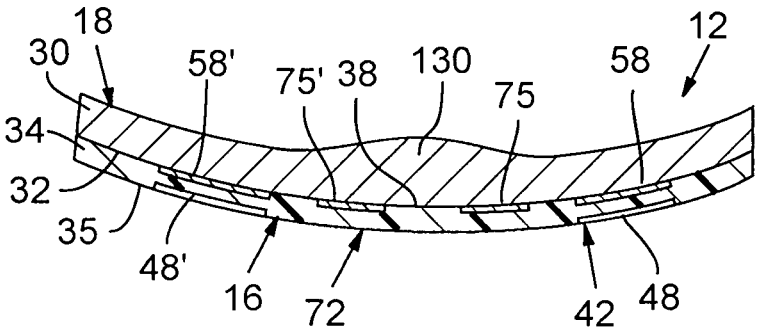
FIG. 15 is a transverse sectional view of the face insert of FIG. 11, taken along line 15-15 of FIG. 11.
Figure 16:
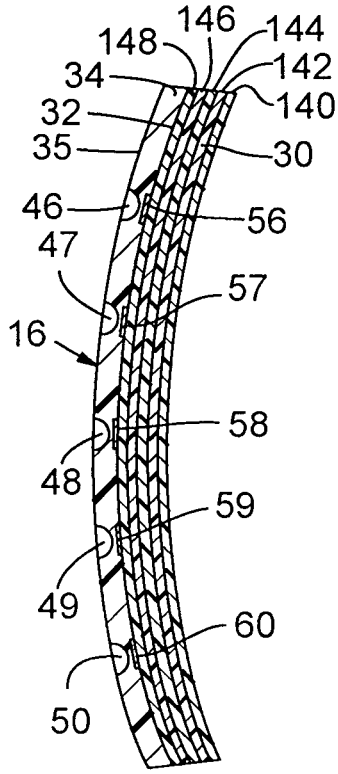
FIG. 16 is a vertical sectional view of an alternative embodiment of the face insert illustrating a substrate that comprises a composite of layers of materials with a portion of a cover layer overlaying the peripheral edge of the face insert.

FIGS. 11 through 15 illustrate an alternative form of face insert in which the cover layer 34 overlays the peripheral edges of the insert. In this example, FIG. 11 corresponds to FIG. 2; FIG. 12 corresponds to FIG. 3; FIG. 13 corresponds to FIG. 4; FIG. 14 corresponds to FIG. 5; and FIG. 15 corresponds to FIG. 6. Because of this correspondence, the numbers used in FIG. 2 through FIG. 6 have been used for corresponding elements in FIGS. 11 through FIG. 15 and will not be described in detail. FIGS. 12-15 illustrate the cover layer 34 extending beyond the striking surface of the insert and overlying the peripheral edge of the substrate. FIG. 16. corresponds to FIG. 8, except that FIG. 16 illustrates an embodiment wherein the cover layer 34 overlays the peripheral edge of the laminates forming the substrate of FIG. 16. Covering the laminate edges with the cover layer assists in protecting the laminate edges against de-lamination. The cover layer and the insert will be of a size and characteristics that meet USGA requirements.

Having illustrated and described the technology herein with respect to a number of exemplary embodiments, it will be apparent to those of ordinary skill in the art that such embodiments can be modified in arrangement and detail without departing from the inventive principles disclosed herein. I claim all such modifications that fall within the spirit and scope of the following claims.

The invention claimed is:

1. A face insert for a wood-type golf club head comprising:

a substrate comprising a score line groove-free front surface;

a polymer layer on at least the front surface of the substrate, the polymer layer comprising a ball-striking surface spaced by the polymer layer from the substrate;

plural elongated score line grooves extending into the polymer layer from the ball-striking surface; and visible markings interposed between the polymer layer and the front surface of the substrate, the visible markings being visible through the polymer layer and comprising elongated score line markings:

wherein the substrate comprises a peripheral edge and the polymer layer overlays at least both the peripheral edge and the front surface of the substrate;

wherein said substrate comprises a heel portion and a toe portion and wherein the elongated score line grooves comprise a first set of plural elongated grooves extending into the polymer layer and positioned at least partially across the ball striking surface of the toe portion of the substrate and a second set of plural elongated grooves extending into the polymer layer and positioned at least partially across the ball striking surface of the heel portion of the substrate;

wherein the score line markings comprise a first set of plural score line markings extending at least partially across the toe portion of the substrate and second set of plural score line markings extending at least partially across the heel portion of the substrate;

wherein the first set of plural elongated grooves overlies and is substantially aligned with and spaced from the first set of score line markings and wherein the second set of plural elongated grooves overlies and is substantially aligned with and spaced from the second set of score line markings.

2. A face insert for a golf club head according to claim 1 wherein the visible markings further comprise target markings interposed between the polymer layer and the front surface of the substrate at a central portion of the substrate, the target markings being visible through the polymer layer.

3. A face insert for a golf club head according to claim 2 wherein the target markings are spaced from the first and second sets of score line markings, wherein the substrate comprises first and second side edges and wherein the score line markings and score line grooves extend in directions perpendicular to the side edges.

4. A face insert for a wood-type golf club head according to claim 1 wherein the visible markings are screen-printed markings.

5. A face insert for a wood-type golf club head according to claim 1 wherein the polymer layer and the elongated score line grooves are molded, the polymer layer being a cured polymer layer.

6. A face insert for a wood-type golf club head according to claim 1 in combination with a golf club head body, wherein the face insert is attached to the golf club head body.

7. A face insert for a wood-type golf club head according to claim 1, wherein the substrate is a composite substrate.

8. A face insert for a wood-type golf club comprising:

a substrate comprising a score line groove-free front surface;

a polymer layer on at least the front surface of the substrate, the polymer layer comprising a ball-striking surface spaced by the polymer layer from the substrate;

plural elongated score line grooves extending into the polymer layer from the ball-striking surface; and visible markings interposed between the polymer layer and the front surface of the substrate, the visible markings being visible through the polymer layer and comprising elongated score line markings;

wherein the substrate comprises a peripheral edge and the polymer layer overlays at least both the peripheral edge and the front surface of the substrate;

wherein said substrate comprises a heel portion, and a toe portion and wherein the elongated score line grooves comprise a first set of plural elongated grooves, extending into the polymer layer and positioned at least partially across the ball striking surface of the toe portion of the substrate and a second set of plural elongated grooves extending into the polymer layer and positioned at least partially across the ball striking surface of the heel portion of the substrate;

wherein the score line markings comprise a first set of plural score line markings extending at least partially across the toe portion of the substrate and a second set of plural score line markings extending at least partially across the heel portion of the substrate;

wherein the visible markings further comprise target markings interposed between the polymer layer and the front surface of the substrate at a central portion of the substrate, the target markings being visible through the polymer layer;

wherein the substrate comprises a composite substrate for a face insert for a golf club head, the composite substrate having a layer of woven substrate material visible through the polymer layer, the polymer layer being a cured polymer layer.

9. A face insert for a golf club head according to claim 8 wherein the target markings are spaced from the first and second sets of score line markings, wherein the substrate comprises first and second side edges and wherein the score line markings and score line grooves extend in directions perpendicular to the side edges.

10. A face insert for a golf club head according to claim 8 wherein the visible markings are screen-printed markings.

11. A face insert for a golf club head according to claim 8 in combination with a golf club head body, wherein the face insert is attached to the golf club head body.

12. A face insert for a wood-type golf club head comprising:

a substrate comprising a score line groove-free front surface;

a polymer layer on at least the front surface of the substrate, the polymer layer comprising a ball-striking surface spaced by the polymer layer from the substrate;

plural elongated score line grooves extending into the polymer layer from the ball-striking surface;

visible markings interposed between the polymer layer and the front surface of the substrate, the visible markings being visible through the polymer layer and comprising elongated score line markings;

wherein the substrate comprises a peripheral edge and the polymer layer overlays at least both the peripheral edge and the front surface of the substrate;

wherein said substrate comprises a heel portion and a toe portion wherein the elongated score line grooves comprise a first set of plural elongated grooves extending into the polymer layer and positioned at least partially across the ball striking surface of the toe portion of the substrate and a second set of plural elongated grooves extending into the polymer layer and positioned at least partially across the ball striking surface of the heel portion of the substrate;

wherein the score line markings comprise a first set of plural score line markings extending at least partially across the toe portion of the substrate and a second set of plural score line markings extending at least partially across the heel portion of the substrate; and wherein the first set of plural elongated grooves overlies and is substantially aligned with the first set of score line markings and wherein the second set of plural elongated grooves overlies and is aligned with the second set of score line markings, the first set of score line markings being spaced by polymer of the polymer layer from the first set of elongated grooves and the second set of score line markings being spaced by polymer of the polymer layer from the second set of elongated grooves.

13. A face insert for a golf club head according to claim 12 in combination with a golf club head body, wherein the face insert is attached to the golf club head body.

14. A face insert for a wood-type golf club head comprising:

a substrate comprising a score line groove-free front surface;

a polymer layer on at least the front surface of the substrate, the polymer layer comprising a ball-striking surface spaced by the polymer layer from the substrate:

plural elongated score line grooves extending into the polymer layer from the ball-striking surface;

visible markings interposed between the polymer layer and the front surface of the substrate, the visible markings being visible through the polymer layer and comprising elongated score line markings;

wherein the substrate comprises a peripheral edge and the polymer layer overlays at least both the peripheral edge and the front surface of the substrate:

wherein said substrate comprises a heel portion and a toe portion wherein the elongated score line grooves comprise a first set of plural elongated grooves extending into the polymer layer and positioned at least partially across the ball striking surface of the toe portion of the substrate and a second set of plural elongated grooves extending into the polymer layer and positioned at least partially across the ball striking surface of the heel portion of the substrate;

wherein the score line markings comprise a first set of plural score line markings extending at least partially across the toe portion of the substrate and a second set of plural score line markings extending at least partially across the heel portion of the substrate;

wherein the visible markings further comprise target markings at a central portion of the substrate;

wherein the target markings are spaced from the first and second sets of score line markings; and wherein the first set plural elongated grooves overlies and is substantially aligned with the first set of score line markings and wherein the second set of plural elongated grooves overlies and is aligned with the second set of score line markings;

wherein the substrate comprises a composite substrate for a face insert for a golf club head, the composite substrate having a layer of woven substrate material visible through the polymer layer, the polymer layer being a cured polymer layer.

15. A face insert for a golf club head according to claim 14 wherein the visible markings are screen-printed markings; and wherein the polymer layer and the elongated score line grooves are molded, the polymer layer being a cured polymer layer.

16. A face insert for a golf club head according to claim 15 in combination with a golf club head body, wherein the face insert is attached to the golf club head body.

17. A face insert for a golf club head according to claim 6 in combination with a golf club head body, wherein the face insert is attached to the golf club head body.

* * * * *

UNITED STATES PATENT AND TRADEMARK OFFICE

CERTIFICATE OF CORRECTION

PATENT NO. : 7,985,146 B2
APPLICATION NO. : 11/823638
DATED : July 26, 2011
INVENTOR(S) : Lin et al.

It is certified that error appears in the above-identified patent and that said Letters Patent is hereby corrected as shown below:

On the Title page of the Patent:

In the Inventors section; "Citra A. Le" should read --Citra A. Ie--

In the Claims:

Column 16, line 64, Claim 5, "A face insert for a wood-type golf club head according to claim 1" should read --A face insert for a wood-type golf club head according to claim 4--

Column 20, line 7, Claim 17, "A face insert for a golf club head according to claim 6" should read --A face insert for a golf club head according to claim 14--

Signed and Sealed this
Nineteenth Day of March, 2013

Teresa Stanek Rea
*Acting Director of the United States Patent and Trademark Office*